US010095147B2

(12) United States Patent
Kano et al.

(10) Patent No.: US 10,095,147 B2
(45) Date of Patent: Oct. 9, 2018

(54) CLEANING BODY PROVIDING REDUCED IN-PLANE DENSITY UNEVENNESS AND IMPROVED CLEANING PERFORMANCE, ASSEMBLY, AND IMAGE FORMING APPARATUS

(71) Applicant: FUJI XEROX CO., LTD., Tokyo (JP)

(72) Inventors: Fuyuki Kano, Kanagawa (JP); Minoru Rokutan, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/452,060

(22) Filed: Mar. 7, 2017

(65) Prior Publication Data

US 2018/0059568 A1 Mar. 1, 2018

(30) Foreign Application Priority Data

Aug. 23, 2016 (JP) ..... 2016-162951

(51) Int. Cl.
*G03G 15/02* (2006.01)
*G03G 21/00* (2006.01)

(52) U.S. Cl.
CPC ..... *G03G 15/0225* (2013.01); *G03G 15/0258* (2013.01); *G03G 21/0058* (2013.01)

(58) Field of Classification Search
CPC ..... G03G 15/0225; G03G 15/0258; G03G 15/166; G03G 15/168; G03G 21/0058
See application file for complete search history.

(56) References Cited

U.S. PATENT DOCUMENTS

| | | | | |
|---|---|---|---|---|
| 9,372,427 | B1 * | 6/2016 | Kano | G03G 15/0291 |
| 2011/0170897 | A1 * | 7/2011 | Hagiwara | G03G 15/0225 399/100 |
| 2011/0170901 | A1 * | 7/2011 | Kawai | G03G 15/0258 399/100 |
| 2012/0002998 | A1 | 1/2012 | Kawai | |
| 2013/0089354 | A1 * | 4/2013 | Kano | G03G 15/0225 399/100 |
| 2013/0108311 | A1 * | 5/2013 | Kawai | G03G 15/0225 399/100 |

FOREIGN PATENT DOCUMENTS

| | | | |
|---|---|---|---|
| JP | 2006276404 | A | * 10/2006 |
| JP | 2011145412 | A | * 7/2011 |
| JP | 2012-014011 | A | 1/2012 |

* cited by examiner

*Primary Examiner* — David M Gray
*Assistant Examiner* — Laura Roth
(74) *Attorney, Agent, or Firm* — Sughrue Mion, PLLC

(57) ABSTRACT

A cleaning body includes a shaft and an elastic layer that is helically wound around the shaft from one end side to the other end side of the shaft and fixed on the shaft and that cleans a body to be cleaned while the elastic layer rotates. The elastic layer includes a division portion having plural divided segments and having a length of from 20% to 70% of the full length of the elastic layer. The division portion is located in a longitudinal central portion of the elastic layer. In the sectional view perpendicular to the axial direction of the shaft, a minimum thickness part in the longitudinal central portion of the elastic layer is from 5% to 12% thicker than a minimum thickness part in each longitudinal end portion of the elastic layer.

10 Claims, 10 Drawing Sheets

FIG. 12

| | CLEANING ROLLER | AXIAL CENTRAL PORTION | | | MINIMUM THICKNESS PART | | | AMOUNT OF NIPPING | | | EVALUATION RESULTS | |
|---|---|---|---|---|---|---|---|---|---|---|---|---|
| | | NUMBER OF DIVIDED SEGMENTS | DIVISION POSITION (mm) | RATIO TO FULL LENGTH | CENTRAL REGION (mm) | END OUTSIDE REGION (mm) | RATIO OF END OUTSIDE REGION TO CENTRAL REGION | CENTRAL REGION (mm) | END OUTSIDE REGION (mm) | RATIO OF END OUTSIDE REGION TO CENTRAL REGION | IN-PLANE DENSITY UNEVENNESS | CLEANING PERFORMANCE |
| EXAMPLE 1 | CLEANING ROLLER 1 | 2 | 100 TO 238 | 41% | 2.25 | 2.37 | 1.05 | 0.90 | 1.02 | 1.13 | G0 | G0 |
| EXAMPLE 2 | CLEANING ROLLER 2 | 2 | 135 TO 203 | 20% | 2.25 | 2.37 | 1.05 | 0.90 | 1.02 | 1.13 | G0 | G0 |
| EXAMPLE 3 | CLEANING ROLLER 3 | 2 | 75 TO 263 | 56% | 2.25 | 2.37 | 1.05 | 0.90 | 1.02 | 1.13 | G0 | G0 |
| EXAMPLE 4 | CLEANING ROLLER 4 | 2 | 50 TO 288 | 70% | 2.25 | 2.37 | 1.05 | 0.90 | 1.02 | 1.13 | G0 | G0 |
| EXAMPLE 5 | CLEANING ROLLER 5 | 2 | 100 TO 238 | 41% | 2.60 | 2.84 | 1.09 | 1.25 | 1.49 | 1.19 | G0 | G0 |
| EXAMPLE 6 | CLEANING ROLLER 6 | 2 | 100 TO 238 | 41% | 2.60 | 2.92 | 1.12 | 1.25 | 1.57 | 1.26 | G0 | G0 |
| EXAMPLE 7 | CLEANING ROLLER 7 | 3 | 100 TO 238 | 41% | 2.25 | 2.39 | 1.06 | 0.90 | 1.04 | 1.16 | G0 | G0 |
| COMPARATIVE EXAMPLE 1 | COMPARATIVE CLEANING ROLLER 1 | NO DIVISION | — | — | 2.25 | 2.27 | 1.01 | 0.90 | 0.92 | 1.02 | G2 | G2 |
| COMPARATIVE EXAMPLE 2 | COMPARATIVE CLEANING ROLLER 2 | 2 | 140 TO 198 | 17% | 2.25 | 2.37 | 1.05 | 0.90 | 1.02 | 1.13 | G2 | G1 |
| COMPARATIVE EXAMPLE 3 | COMPARATIVE CLEANING ROLLER 3 | 2 | 40 TO 298 | 76% | 2.25 | 2.37 | 1.05 | 0.90 | 1.02 | 1.13 | G2 | G1 |
| COMPARATIVE EXAMPLE 4 | COMPARATIVE CLEANING ROLLER 4 | 2 | 100 TO 238 | 41% | 1.85 | 1.93 | 1.04 | 0.50 | 0.58 | 1.16 | G1 | G1 |
| COMPARATIVE EXAMPLE 5 | COMPARATIVE CLEANING ROLLER 5 | 2 | 100 TO 238 | 41% | 2.65 | 2.99 | 1.13 | 1.30 | 1.64 | 1.26 | G1 | G1 |

CLEANING BODY PROVIDING REDUCED IN-PLANE DENSITY UNEVENNESS AND IMPROVED CLEANING PERFORMANCE, ASSEMBLY, AND IMAGE FORMING APPARATUS

CROSS-REFERENCE TO RELATED APPLICATIONS

This application is based on and claims priority under 35 USC 119 from Japanese Patent Application No. 2016-162951 filed Aug. 23, 2016.

BACKGROUND

Technical Field

The present invention relates to a cleaning body, an assembly, and an image forming apparatus.

SUMMARY

According to an aspect of the invention, there is provided a cleaning body including a shaft and an elastic layer that is helically wound around the shaft from one end side to the other end side of the shaft and fixed on the shaft and that cleans a body to be cleaned while the elastic layer rotates. The elastic layer includes a division portion having plural divided segments and having a length of from 20% to 70% of the full length of the elastic layer. The division portion is located in a longitudinal central portion of the elastic layer. In the sectional view perpendicular to the axial direction of the shaft, a minimum thickness part in the longitudinal central portion of the elastic layer is from 5% to 12% thicker than a minimum thickness part in each longitudinal end portion of the elastic layer.

BRIEF DESCRIPTION OF THE DRAWINGS

Exemplary embodiments of the present invention will be described in detail based on the following figures, wherein:

FIG. 12 illustrates a table showing the evaluation results of cleaning rollers according to Examples and cleaning rollers according to Comparative Examples.

DETAILED DESCRIPTION

Figure 1:
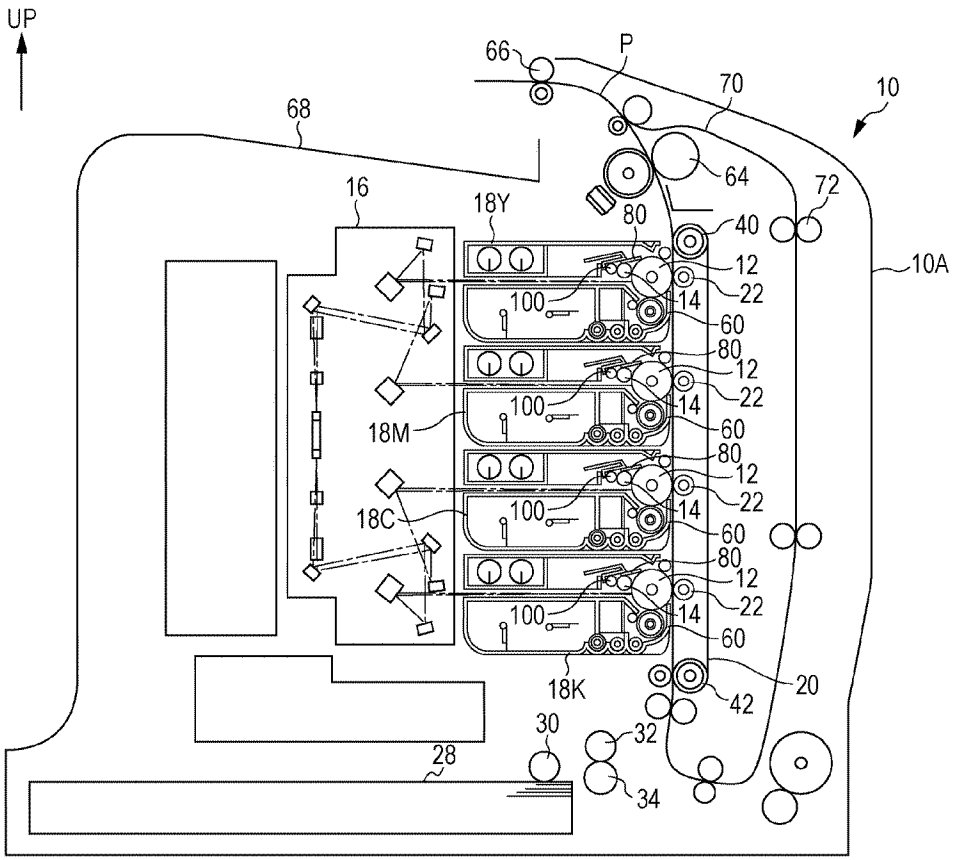
FIG. 1 is a schematic diagram illustrating an image forming apparatus according to an exemplary embodiment.

Exemplary embodiments of the invention will be described below in detail based on the figures. The numerical ranges expressed by using "to" in the exemplary embodiments denote ranges including the numerical values before and after "to" as the minimum value and the maximum value. An image forming apparatus 10 according to an exemplary embodiment is, for example, a tandem-system full-color image forming apparatus such as that illustrated in FIG. 1. In FIG. 1, arrow UP indicates the upper direction of the image forming apparatus 10. In addition, components having the same function may be provided with the same reference symbol (reference symbol from which alphabetic characters are omitted).

First, the schematic structure of the image forming apparatus 10 will be described. The image forming apparatus 10 has an apparatus body 10A. The apparatus body 10A internally includes process cartridges 18K, 18C, 18M, and 18Y sequentially from below, which are example assemblies corresponding to black (K), cyan (C), magenta (M), and yellow (Y).

Figure 2:
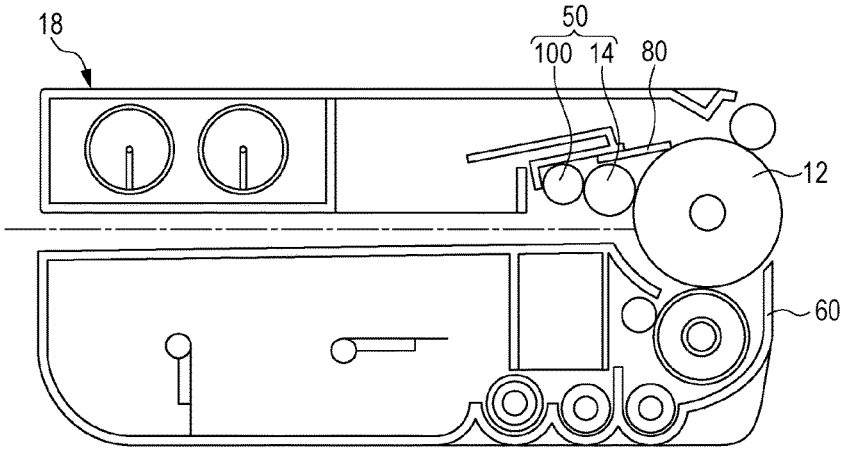
FIG. 2 is a schematic diagram illustrating a process cartridge according to an exemplary embodiment.

As illustrated in FIG. 2, each process cartridge 18 includes a photoreceptor 12, which is an example image carrier (body to be charged) that can carry an image, a charging device 50 that includes a charging roller 14, which is an example charging body (body to be cleaned), and a developing device 60. Each process cartridge 18 is removable from the apparatus body 10A. Each assembly according to the exemplary embodiment includes at least the photoreceptor 12 and the charging device 50.

As illustrated in FIG. 1, the outer circumferential surface of the photoreceptor 12 is charged by the charging roller 14 disposed in contact with the outer circumferential surface of the photoreceptor 12 and then exposed to a laser beam emitted from an exposure device 16 disposed downstream of the charging roller 14 in the rotation direction of the photoreceptor 12. This configuration allows an electrostatic latent image corresponding to image information to form on the outer circumferential surface of the photoreceptor 12.

The electrostatic latent images formed on the outer circumferential surfaces of the photoreceptors 12 are respectively developed by developing devices 60 corresponding to black (K), cyan (C), magenta (M), and yellow (Y) colors to form toner images for respective colors. That is, the toner images corresponding to black (K), cyan (C), magenta (M), and yellow (Y) colors are respectively formed on the outer circumferential surfaces of the photoreceptors 12 for these colors by performing the charging, exposing, and developing processes on the outer circumferential surfaces of the photoreceptors 12 corresponding to black (K), cyan (C), magenta (M), and yellow (Y) colors.

A sheet of recording paper P is drawn from a paper storage container 28 by a drawing roller 30 and transported to a transport belt 20 by transport rollers 32 and 34. The transport belt 20 is wound around a drive roller 40 and a driven roller 42 while the transport belt 20 is under tension. The rotary drive of the drive roller 40 causes the side of the transport belt 20 facing the photoreceptors 12 to move upward from below. On the inner circumferential surface of the transport belt 20, transfer rollers 22 corresponding to the photoreceptors 12 are disposed.

Therefore, the toner images of black (K), cyan (C), magenta (M), and yellow (Y) colors respectively formed on the outer circumferential surfaces of the photoreceptors 12 are sequentially transferred to a sheet of recording paper P, which is transported by the transport belt 20, from the outer circumferential surfaces of the photoreceptors 12 at transfer positions at which the transport belt 20 supported by the transfer rollers 22 faces the photoreceptors 12. The sheet of recording paper P to which the toner images have been transferred from the outer circumferential surfaces of the photoreceptors 12 are transported to a fixing device 64. The toner images are then fixed on the sheet of recording paper P by heating and pressing.

In the case of single-sided printing, the sheet of recording paper P on which the toner images have been fixed is discharged onto a discharge part 68 in the upper part of the image forming apparatus 10 by a discharge roller 66. In the case of double-sided printing, the trailing edge of the sheet of recording paper P having the front surface on which the toner images have been fixed by the fixing device 64 is supported by the discharge roller 66, and then the inverse rotation of the discharge roller 66 causes the sheet of recording paper P to be transported to a transport path 70 for double-sided printing.

The front-back reversed sheet of recording paper P transported by a transport roller 72 disposed on the transport path 70 is then transported onto the transport belt 20 again. This transport causes the toner images to be transferred to the back surface of the sheet of recording paper P from the outer circumferential surfaces of the photoreceptors 12. The fixing device 64 fixes the toner images on the sheet of recording paper P having the back surface to which the toner images have been transferred. The sheet of recording paper P having the back surface on which the toner images have been fixed is then discharged onto the discharge part 68 by the discharge roller 66.

Residual toners, paper powder, and the like that remain on the outer circumferential surfaces of the photoreceptors 12 after the process for transferring the toner images is complete are removed by cleaning blades 80, which are disposed downstream of the transfer positions in the rotation direction of the photoreceptors 12, after each rotation of the photoreceptors 12. This configuration allows the outer circumferential surfaces of the photoreceptors 12 to be ready for the subsequent image forming process.

Next, the charging device 50 (see FIG. 2 and FIG. 3) including the charging roller 14, which is an example body to be cleaned, and the cleaning device 100 having the cleaning roller 102, which is an example cleaning body that cleans the charging roller 14, will be described.

Figure 3:
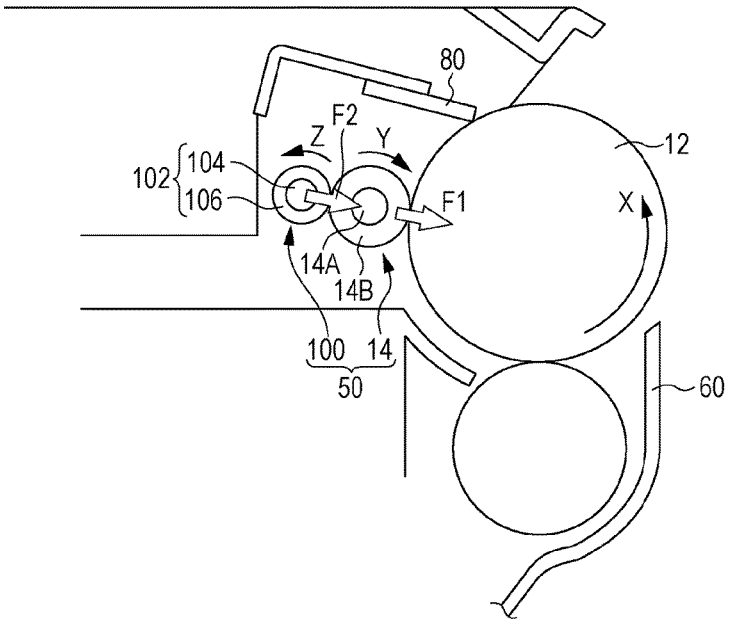
FIG. 3 is a schematic diagram illustrating the structure of a charging device according to an exemplary embodiment as viewed in the axial direction.

As illustrated in FIG. 2 and FIG. 3, the charging roller 14 has, for example, a roll shape in which an elastic layer 14B is formed around a shaft 14A. The shaft 14A is rotatably supported. The charging roller 14 is pressed against the photoreceptor 12 by applying a load F1 to both end portions of the shaft 14A, so that the charging roller 14 is elastically deformed along the surface (outer circumferential surface) of the elastic layer 14B to form a nip part.

The photoreceptor 12 is driven to rotate by a motor, not shown, in the direction of arrow X. The charging roller 14 accordingly rotates in the direction of arrow Y by following the rotation of the photoreceptor 12. The cleaning roller 102 is driven to rotate in the direction of arrow Z by the rotation of the charging roller 14. As described below, the cleaning roller 102 is pressed against the charging roller 14 by applying a load F2 to both end portions of the shaft 104, which prevents or reduces deformation of the charging roller 14.

Examples of the structure of the charging roller 14 include, but are not limited to, a structure including the shaft 14A and the elastic layer 14B or a resin layer instead of the elastic layer 14B. The elastic layer 14B may have a single layer structure or may have a multiple layer structure composed of different layers having different functions. Furthermore, the outer circumferential surface of the elastic layer 14B may undergo a surface treatment.

The shaft 14A is made of, for example, conductive free-cutting steel or stainless steel. The material and the surface treatment method are appropriately selected according to desired properties, such as sliding properties. For example, when the material of the shaft 14A is a non-conductive material, the shaft 14A may be processed to have conductivity by an ordinary electrical conduction treatment, such as a plating treatment.

Although the elastic layer 14B is a conductive foamed elastic layer, the conductive foamed elastic layer may be a material obtained by adding, for example, to an elastic material having elasticity such as rubber, a conductive agent for adjusting the resistance of the conductive foamed elastic layer, and if desired, materials that may be added to ordinary rubber, such as a softener, a plasticizer, a hardener, a vulcanizing agent, a vulcanization accelerator, an antiaging agent, and a filler such as silica or calcium carbonate.

That is, the elastic layer 14B is formed by coating the outer circumferential surface of the conductive shaft 14A with a mixture containing materials to be added to ordinary rubber. The conductive agent intended to adjust the resistance value may be, for example, a conductive agent obtained by dispersing a material that conducts electricity by using, as charge carriers, at least either electrons or ions, such as carbon black or an ion conductive agent contained in the matrix material.

The elastic material that forms the conductive foamed elastic layer is produced by, for example, dispersing a conductive agent in a rubber material. Examples of the rubber material include a silicone rubber, an ethylene propylene rubber, an epichlorohydrin-ethylene oxide copolymer rubber, an epichlorohydrin-ethylene oxide-allyl glycidyl ether copolymer rubber, an acrylonitrile-butadiene copolymer rubber, and blended rubbers thereof. These rubber materials may be foamed or non-foamed.

An electroconductive agent and an ion conductive agent are used as a conductive agent. Examples of the electroconductive agent include fine powders formed of carbon blacks, such as Ketjenblack and acetylene black; fine powders formed of pyrolytic carbon or graphite; fine powders formed of various conductive metals, such as aluminum, copper, nickel, and stainless steel, or alloys thereof; fine powders formed of various conductive metal oxides, such as tin oxide, indium oxide, titanium oxide, tin oxide-antimony oxide solid solution, and tin oxide-indium oxide solid solution; and fine powders formed of materials obtained by processing the surfaces of insulating materials to have conductivity.

Examples of the ion conductive agent include perchlorates and chlorates of oniums, such as tetraethylammonium and lauryltrimethylammonium; perchlorates and chlorates of alkali metals, such as lithium and magnesium, and alkaline earth metals. These conductive agents may be used alone or in combination of two or more.

The amount of the conductive agent added is not limited. The amount of the electroconductive agent added may be in the range of 1 part by weight or more and 60 parts by weight or less with respect to 100 parts by weight of the rubber material. The amount of the ion conductive agent added may be in the range of 0.1 parts by weight or more and 5.0 parts by weight or less with respect to 100 parts by weight of the rubber material. When the resistance value is controlled with such a conductive agent, the resistance value of the elastic layer 14B does not change depending on the environmental conditions, which may result in stable properties.

A surface layer may be formed on the outer circumferential surface of the elastic layer 14B. The surface layer may be made of any material, such as resin or rubber. Examples of the material of the surface layer include polyvinylidene fluoride, tetrafluoroethylene copolymers, polyester, polyimide, and copolymer nylon. Furthermore, the surface layer may be made of, for example, a fluorine-based or silicone-based resin, and may be made of a fluorine-modified acrylate polymer.

Figure 4:
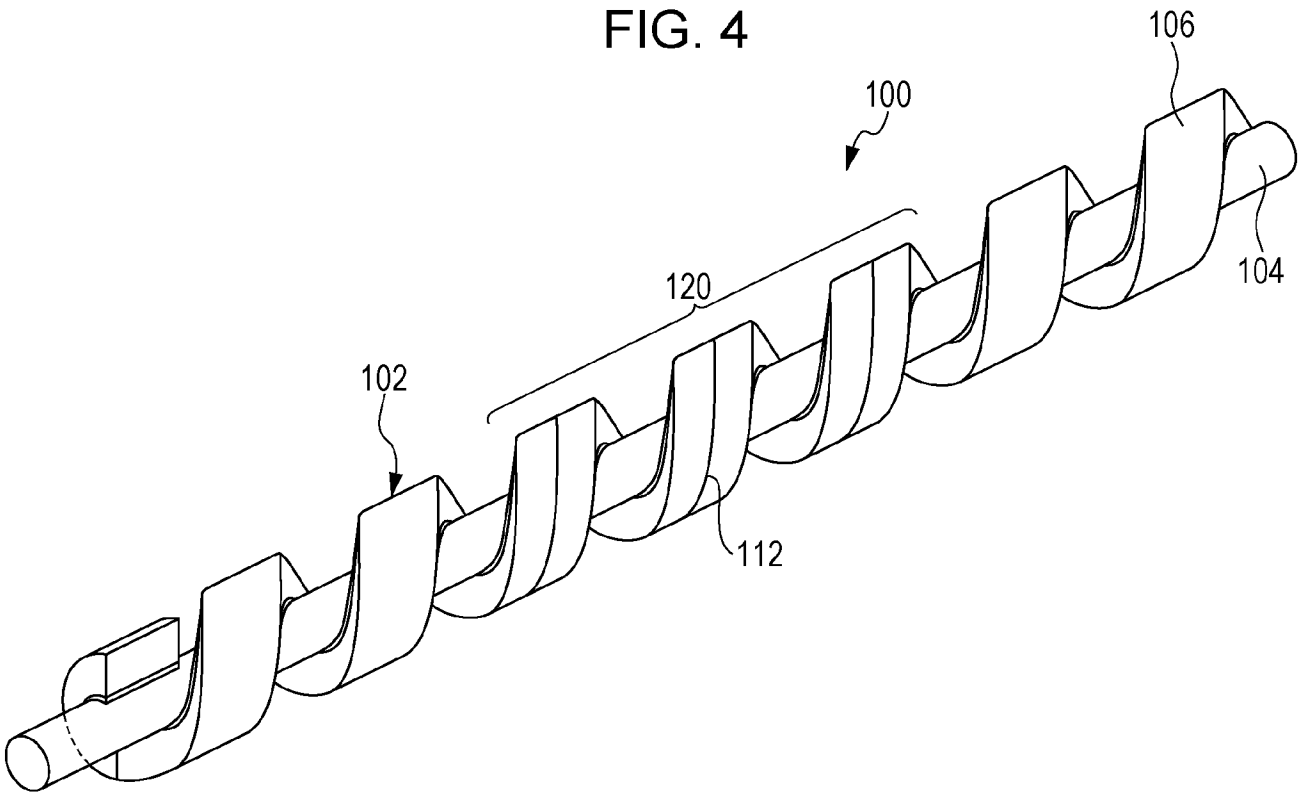
FIG. 4 is a schematic perspective view of a cleaning roller according to an exemplary embodiment.
Figure 5:
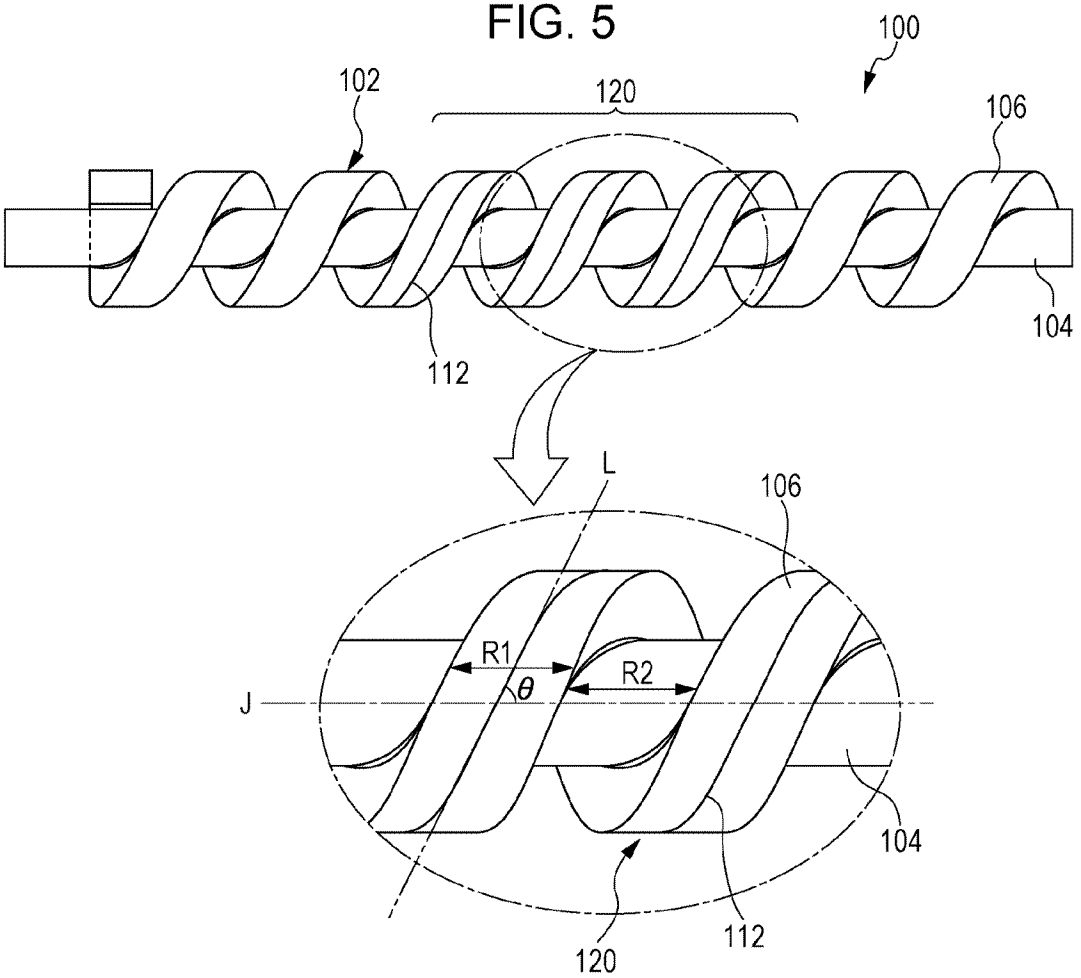
FIG. 5 is a schematic plan view of the cleaning roller according to the exemplary embodiment.

As illustrated in FIG. 4 and FIG. 5, the cleaning device 100 includes the cleaning roller 102 having a roll shape. The cleaning roller 102 includes the shaft 104, which is an example shaft (core body), the elastic layer 106, and an adhesive layer 108 (see FIG. 6) for achieving adhesion between the shaft 104 and the elastic layer 106.

The shaft 104 is disposed in the rotational axis direction (hereinafter referred to simply as the "axial direction") of the charging roller 14. The axial length of the shaft 104 is larger than the axial length of the elastic layer 14B in the charging roller 14. One axial end portion and the other axial end portion of the shaft 104 respectively extend axially beyond one axial end portion and the other axial end portion of the elastic layer 14B in the charging roller 14.

Examples of the material used for the shaft 104 include metals, such as free-cutting steel or stainless steel, and resins, such as polyacetal resin (POM). The material and the surface treatment method are appropriately selected as desired. For example, when the shaft 104 is made of a non-conductive material, such as resin, the shaft 104 may be used as it is but may be processed to have electrical conductivity by an ordinary treatment such as a plating treatment. When the shaft 104 is made of metal, the shaft 104 may undergo a plating treatment.

The elastic layer 106 is helically disposed on the outer circumferential surface of the shaft 104 from one axial end side to the other axial end side of the shaft 104. Specifically, as illustrated in FIG. 9, the elastic layer 106 is formed by, for example, helically winding a strip-shaped foamed elastic member (hereinafter referred to as a "strip 110") at predetermined intervals around the shaft 104, which serves as a helix axis, from one axial end portion to the other axial end portion of the shaft 104. Specific materials of the elastic layer 106 will be described below.

Figure 6A:
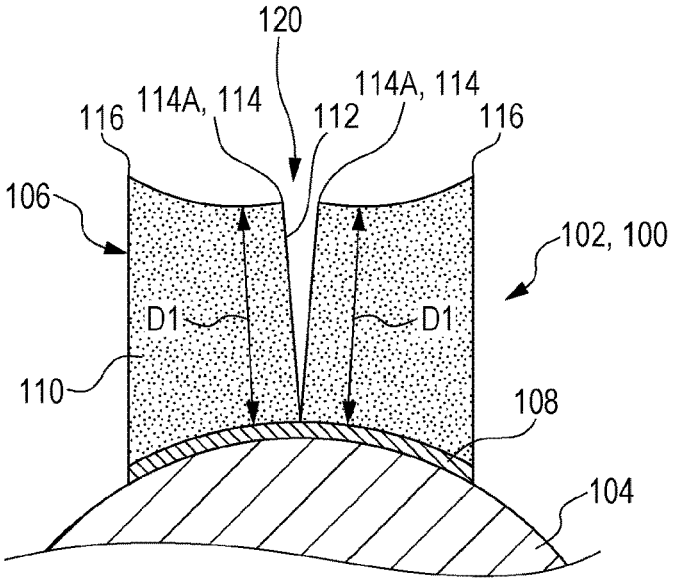
FIG. 6A is a schematic sectional view of a central portion of the cleaning roller according to the exemplary embodiment as viewed in the axial direction.
Figure 6B:
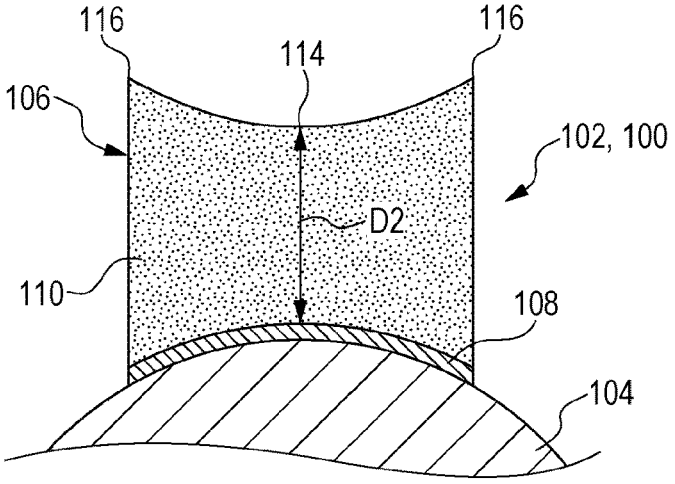
FIG. 6B is a schematic sectional view of each end portion of the cleaning roller according to the exemplary embodiment as viewed in the axial direction.

Examples of the adhesive layer 108 illustrated in FIG. 6A and FIG. 6B include a double-sided tape. The adhesive layer 108 may be made of any material that achieves adhesion between the outer circumferential surface of the shaft 104 and the elastic layer 106 (strip 110) and may be formed of, for example, an adhesive other than the double-sided tape.

Figure 8A:
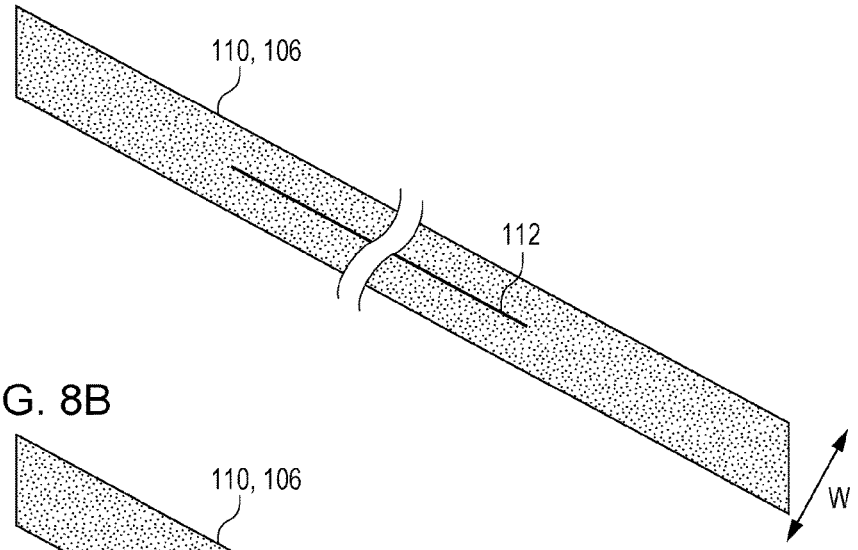
FIGS. 8A to 8C are schematic plan views of a developed elastic layer of the cleaning roller according to the exemplary embodiment.

As illustrated in FIG. 4 and FIG. 5, the cleaning roller 102 is divided into plural segments (e.g., two segments) in a certain range in a longitudinal (the axial direction of the shaft 104) central portion of the elastic layer 106, specifically, in the range of from 20% to 70% of the longitudinal full length. That is, as illustrated in FIG. 8A, a linear cut 112 extending in the longitudinal direction of the strip 110 is formed in a lateral central portion of the strip 110. The cut 112 has a length of from 20% to 70% of the longitudinal full length of the strip 110.

This cut 112 allows a division portion 120 having plural divided segments to form in the longitudinal central portion of the elastic layer 106. This cut 112 does not reach the adhesive layer 108 as illustrated in FIG. 6A. The length of the cut 112 (the range in which the longitudinal central portion of the elastic layer 106 is divided) is preferably in the range of from 20% to 70% of the longitudinal full length of the strip 110, more preferably in the range of from 30% to 60%, and particularly preferably in the range of from 40% to 50%.

Figure 8B:
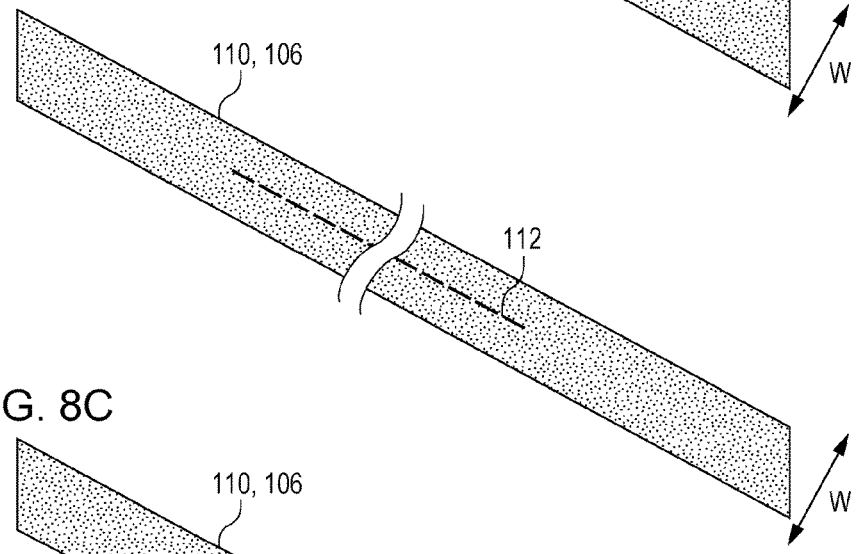
Figure 8C:
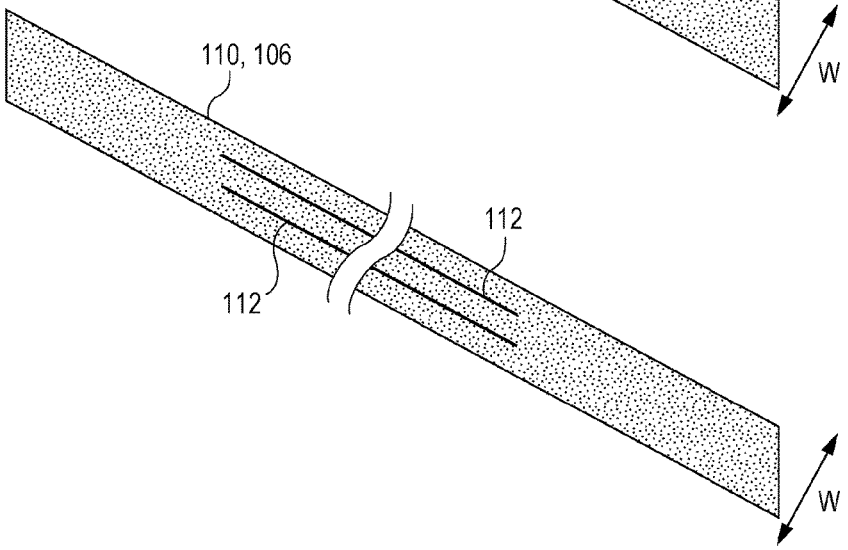

As long as the length of the cut 112 is in the above-mentioned range, the cut 112 may be formed intermittently (composed of plural divided cuts in the longitudinal direction) as illustrated in FIG. 8B, or plural (e.g. two) cuts 112 may be laterally adjacent to each other as illustrated in FIG. 8C. In case of the strip 110 illustrated in FIG. 8C, a division portion 120 having three divided segments is formed in a certain range of the longitudinal central portion of the elastic layer 106.

As illustrated in FIG. 6A and FIG. 6B, the elastic layer 106 has a quadrangular shape enclosed by four sides (including curves) in the sectional view in the axial direction of the shaft 104. The lateral (the direction indicated by W in FIG. 8) end portions of the elastic layer 106 respectively have protrusions 116 that protrude beyond the lateral central portion 114 in the radial direction of the shaft 104 and that are formed in the longitudinal direction of the elastic layer 106.

That is, the protrusions 116 are formed by applying tension to the elastic layer 106 (strip 110) in the longitudinal direction to produce a difference in outer diameter between the lateral central portion 114 and the lateral end portions in the outer surface of the elastic layer 106. As illustrated in FIG. 6A, in the division portion 120 having plural segments divided by the cut 112, protrusions 114A similar to the protrusions 116 are also formed in the lateral central portion 114 in the longitudinal direction of the elastic layer 106.

When a minimum thickness part D1 (see FIG. 6A) in the longitudinal central portion (the division portion 120 having plural segments divided by the cut 112) of the elastic layer 106 includes plural segments divided by the cut 112, the minimum thickness part D1 is from 5% to 12% thicker than a minimum thickness part D2 (see FIG. 6B) in each longitudinal end portion of the elastic layer 106 (the region outside the longitudinal central portion in the longitudinal direction (the axial direction of the shaft 104)).

The minimum thickness part D2 in each longitudinal end portion (each end portion with no cut 112) of the elastic layer 106 has a thickness of, for example, 1.0 mm to 3.0 mm, preferably 1.4 mm to 2.6 mm, more preferably 1.6 mm to 2.4 mm. The thickness of the elastic layer 106 is determined, for example, in the following manner.

While the circumferential direction of the cleaning roller 102 is fixed, the profile of the thickness of the elastic layer 106 is measured by scanning the cleaning roller 102 in the longitudinal direction (the axial direction of the shaft 104) with a laser measuring device (laser scan micrometer available from Mitutoyo Corporation, model: LSM6200) at a traverse speed of 1 mm/sec. Subsequently, the same measurement is performed (at three points 120° apart in the circumferential direction) after displacing the cleaning roller 102 in the circumferential direction. The thickness of the elastic layer 106 is calculated based on this profile.

Figure 7A:
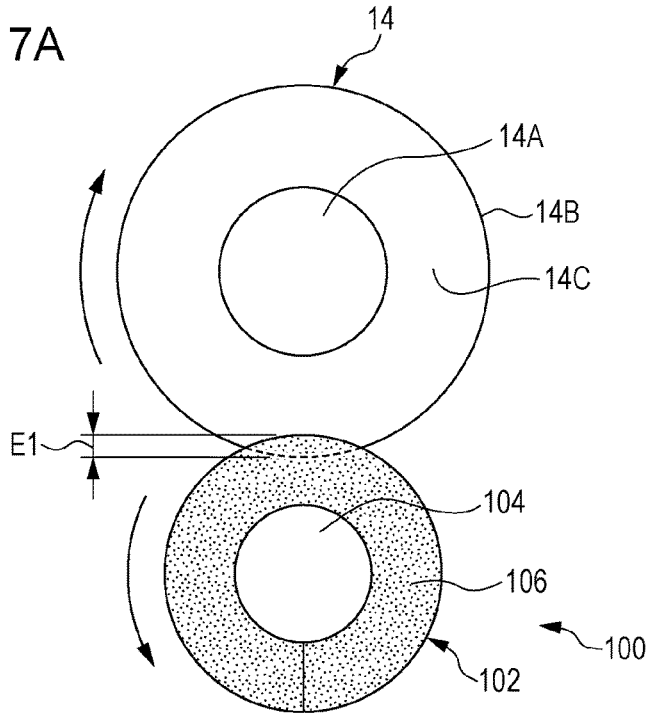
FIG. 7A is a schematic side view illustrating the amount of nipping between the central portion of the cleaning roller according to the exemplary embodiment and a charging roller as viewed in the axial direction.
Figure 7B:
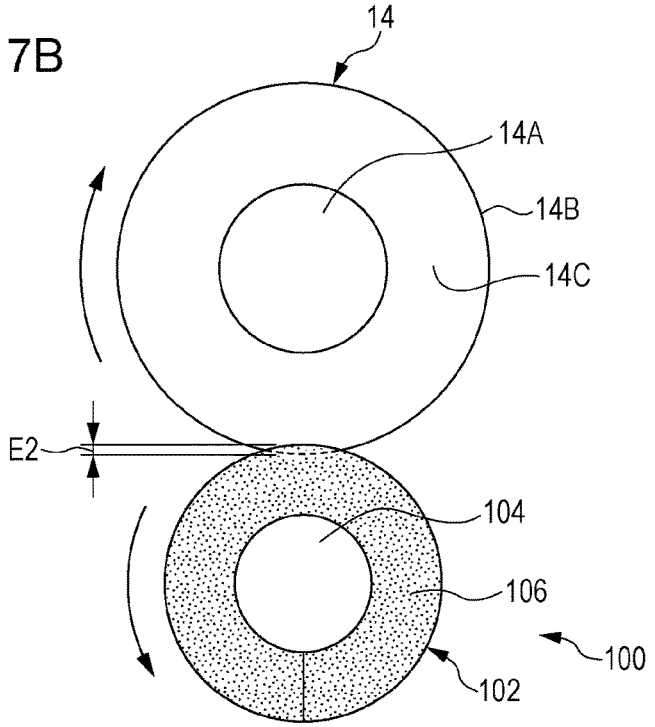
FIG. 7B is a schematic side view illustrating the amount of nipping between each end portion of the cleaning roller according to the exemplary embodiment and the charging roller as viewed in the axial direction.

As illustrated in FIG. 3 and FIG. 7, the elastic layer 106 of the cleaning roller 102 is in contact with the charging roller 14 on its side opposite to the photoreceptor 12. Specifically, the elastic layer 106 of the cleaning roller 102 is pressed against the charging roller 14 by applying a load F2 to both end portions of the shaft 104, so that the elastic layer 106 of the cleaning roller 102 is elastically deformed along the surface (outer circumferential surface) of the elastic layer 14B of the charging roller 14 to form a nip part.

The outer surface of the elastic layer 106 of the cleaning roller 102 accordingly contacts the surface of the elastic layer 14B of the charging roller 14 in the longitudinal direction at a predetermined amount of nipping. Specifically, the amount of nipping E1 (see FIG. 7A) between the longitudinal central portion of the elastic layer 106 and the elastic layer 14B of the charging roller 14 is from 13% to 26% larger than the amount of nipping E2 (see FIG. 7B) between each longitudinal end portion of the elastic layer 106 and the elastic layer 14B of the charging roller 14.

The longitudinal tip portion of the strip 110 may be subjected to a compression treatment in the thickness direction in order to prevent separation of the strip 10 from the shaft 104 after the strip 110 is attached to the shaft 104. Specifically, the longitudinal tip portion of the strip 110 before the strip 110 is attached to the shaft 104 may be subjected to a compression treatment (thermal compression treatment) for applying heat and pressure such that the compression ratio in the thickness direction (thickness after compression/thickness before compression×100) is from 10% to 70%. This compression treatment causes the longitudinal tip portion of the strip 110 to be plastically deformed into a compressed state.

The elastic layer 106 is a foamed elastic layer made of a foamed material, specifically, made of a material that, even if deformed by applying external force at 100 Pa, is restored to its original shape. Examples of the material of the elastic layer 106 include materials obtained by blending one or more materials selected from foamed resins, such as polyurethanes, polyethylenes, polyamides, and polypropylenes, and rubber materials, such as silicone rubber, fluorocarbon rubber, urethane rubber, EPDM, NBR, CR, chlorinated polyisoprene, isoprene, acrylonitrile-butadiene rubber, styrene-butadiene rubber, hydrogenated polybutadiene, and butyl rubber.

To these materials, an auxiliary, such as a foaming auxiliary, a foam stabilizer, a catalyst, a curing agent, a plasticizer, or a vulcanization accelerator, may be added as desired. The elastic layer 106 may be made of foamed polyurethane having high tensile strength in order to prevent or reduce scratching, particularly by friction, of the surface of the body to be cleaned (charging roller 14) or to prevent the elastic layer 106 from being torn or damaged for a long period of time.

Examples of the polyurethane include reaction products between polyols (e.g., polyester polyols, polyether polyesters, and acrylic polyols) and isocyanates (e.g., 2,4-tolylene diisocyanate, 2,6-tolylene diisocyanate, 4,4-diphenylmethane diisocyanate, tolidine diisocyanate, and 1,6-hexamethylene diisocyanate). The polyurethane may include a chain extender (1,4-butanediol or trimethylolpropane).

Polyurethane is typically foamed by using a foaming agent, such as water or an azo compound (e.g., azodicarbonamide or azobisisobutyronitrile). To the foamed polyurethane, an auxiliary, such as a foaming auxiliary, a foam stabilizer, or a catalyst, may be added as desired. Of these foamed polyurethanes, ether-based foamed polyurethane may be used. This is because ester-based foamed polyurethane tends to be degraded by heat and moisture.

A foam stabilizer composed of silicone oil is typically used for ether-based polyurethane. However, an image quality defect may occur because silicone oil may transfer to the body to be cleaned (charging roller 14) during storage (particularly long-term storage under high temperature and high humidity). Therefore, a foam stabilizer other than silicone oil may be used. This may prevent or reduce generation of an image quality defect otherwise caused by the elastic layer 106.

Examples of the foam stabilizer other than silicone oil include organic surfactants free of silicon (Si) (e.g., anionic surfactants, such as dodecylbenzenesulfonic acid and sodium lauryl sulfate). Whether a foam stabilizer other than silicone oil has been used for ether-based foamed polyurethane is determined based on whether composition analysis detects silicon (Si) in the ether-based foamed polyurethane.

The elastic layer 106 is disposed helically. As illustrated in FIG. 5, a specific helix angle θ is preferably from 10° to 65°, and more preferably from 15° to 45°. The helix width R1 at the base of the elastic layer 106 on the adhesive layer 108 side is preferably from 3 mm to 25 mm, and more preferably from 3 mm to 10 mm. In addition, the helix pitch R2 is preferably from 3 mm to 25 mm, and more preferably from 15 mm to 22 mm.

The coverage of the elastic layer 106 over the shaft 104 (the helix width R1 of the elastic layer 106/[the helix width R1 of the elastic layer 106+the helix pitch R2 of the elastic layer 106]) is preferably from 15% to 70%, and more preferably from 25% to 55%.

If the coverage is larger than the above-mentioned range, the time during which the elastic layer 106 is in contact with the body to be cleaned (charging roller 14) is long. Therefore, foreign materials (contaminants) collected on the surface (outer surface) of the elastic layer 106 are more likely to adhere to the body to be cleaned (charging roller 14) again. If the coverage is smaller than the above-mentioned range, it is difficult to stabilize the thickness of the elastic layer 106, and the cleaning performance tends to decrease.

As illustrated in FIG. 5, the helix angle θ denotes an angle (acute angle) at which the longitudinal direction L (helix direction) of the elastic layer 106 and the axial direction J of the shaft 104 intersect. The helix width R1 denotes the dimension of the elastic layer 106 in the axial direction J of the shaft 104. In addition, the helix pitch R2 denotes the distance between adjacent portions of the elastic layer 106 in the axial direction J of the shaft 104.

Next, a method for producing the cleaning roller 102 according to an exemplary embodiment will be described. The outer diameter of the shaft 104 may be, for example, from Ø 3 mm to Ø 6 mm.

Figure 9A:
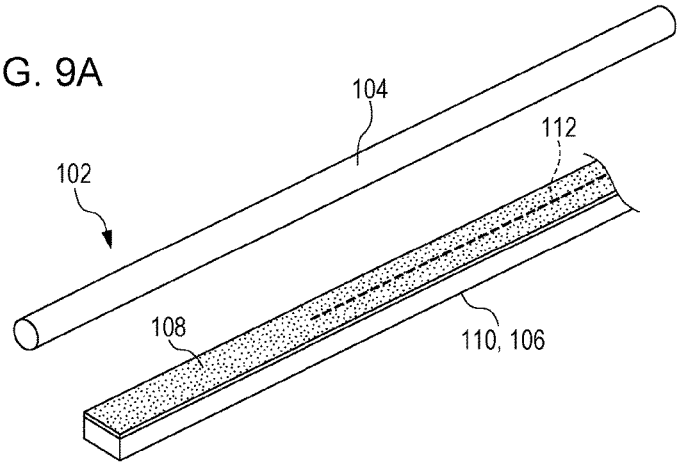
FIGS. 9A to 9C are process diagrams illustrating a method for producing the cleaning roller according to the exemplary embodiment.

First, a sheet-shaped foamed elastic member (e.g., foamed polyurethane sheet) that has been sliced so as to have a desired thickness is prepared. The foamed elastic member is then punched with a punch die to provide the strip 110 having a desired width and a desired length as illustrated in FIG. 9A. Although not illustrated, the longitudinal tip portion of the strip 110 has been compressed in the thickness direction as described above.

Then, a double-sided tape (adhesive layer 108) is stuck to one surface of the strip 110. A cut is made (the cut 112 is formed) in a longitudinal central portion of a surface of the strip 110 opposite to the surface having the double-sided tape (adhesive layer 108). The cut has a length of from 20% to 70% of the longitudinal full length of the strip 110. The cut 112 does not reach the double-sided tape (adhesive layer 108).

Figure 9B:
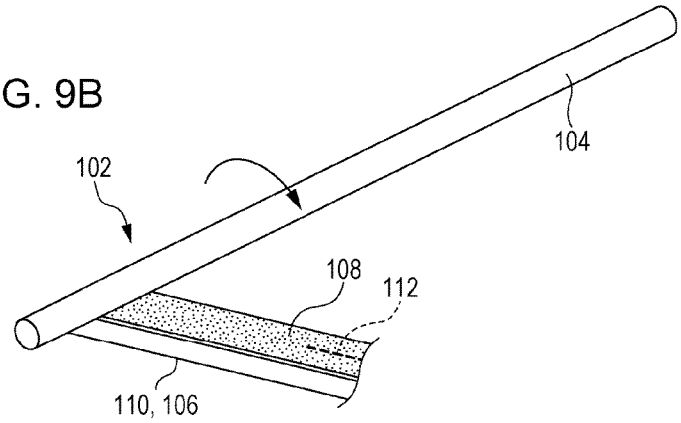
Figure 9C:
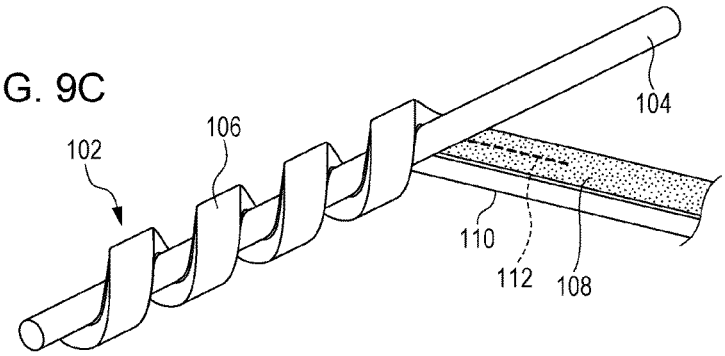

Next, as illustrated in FIG. 9B, the strip 110 is placed such that the surface having the double-sided tape (adhesive layer 108) faces upward, and one end portion of the shaft 104 is placed on the double-sided tape (adhesive layer 108). As illustrated in FIG. 9C, the strip 110 is helically wound around the outer circumferential surface of the shaft 104 by rotating the shaft 104 at a predetermined speed. This provides the cleaning roller 102 having the elastic layer 106 disposed helically around the outer circumferential surface of the shaft 104.

When the strip 110 that serves as the elastic layer 106 is wound around the shaft 104, the strip 110 is positioned such that the longitudinal direction of the strip 110 and the axial direction of the shaft 104 form a desired angle (helix angle θ). The tension applied when the strip 110 is wound around the shaft 104 may be enough to prevent formation of a space between the double-sided tape (adhesive layer 108) of the strip 110 and the shaft 104. Excessive tension may not be applied.

Specifically, the tension applied when the strip 110 is wound around the shaft 104 may be enough to elongate the strip 110 by from 0% to 5% of its original length. This is because excessive tension applied in winding the strip 110 around the shaft 104 tends to result in large tensile permanent elongation and decrease the elastic force of the elastic layer 106 used for cleaning.

Winding the strip 110 around the shaft 104 tends to elongate the strip 110. This elongation tends to vary in the thickness direction of the strip 110. The outermost surface of the strip 110 tends to elongate most, which may reduce its elastic force. Therefore, the elongation of the outermost surface after the strip 110 is wound around the shaft 104 is designed to be 5% of the outermost surface of the original strip 110.

This elongation is controlled by the radius of curvature at which the strip 110 is wound around the shaft 104 and the thickness of the strip 110. The radius of curvature at which the strip 110 is wound around the shaft 104 is controlled by the external diameter of the shaft 104 and the winding angle (helix angle θ) of the strip 110.

The radius of curvature at which the strip 110 is wound around the shaft 104 is preferably, for example, [(the external diameter of the shaft 104/2)+0.2 mm] or more and [(the external diameter of the shaft 104/2)+8.5 mm] or less, and more preferably [(the external diameter of the shaft 104/2)+0.5 mm] or more and [(the external diameter of the shaft 104/2)+7.0 mm] or less.

The thickness of the strip 110 is, for example, from 1.5 mm to 4 mm, and preferably from 1.5 mm to 3.0 mm. The width of the strip 110 may be controlled such that the coverage of the elastic layer 106 is in the above-mentioned range. The length of the strip 110 is determined by, for example, the axial length of a region to be wound around the shaft 104, the winding angle (helix angle θ), and the winding tension.

Next, the operation of the cleaning device 100 (cleaning roller 102) having the above-mentioned structure will be described.

Foreign materials (contaminants), such as a developer, that are not transferred to the sheet of recording paper P and remain on the photoreceptor 12 are removed from the photoreceptor 12 by the cleaning blade 80. Some of foreign materials, such as a developer, that are not removed by the cleaning blade 80 or not scraped off by the cleaning blade 80 adhere to the surface (outer circumferential surface) of the charging roller 14. Some of foreign materials, such as a developer, that float inside the apparatus body 10A of the image forming apparatus 10 adhere to the surface of the charging roller 14.

The foreign materials that adhere to the surface of the charging roller 14 are scraped off from the surface of the charging roller 14 by the protrusions 116 formed over the longitudinal full length of the elastic layer 106 and protrusions 114A formed in a certain range of the longitudinal central portion of the elastic layer 106. Furthermore, these foreign materials are removed by wiping the surface of the charging roller 14 with the outer surface of the elastic layer 106.

The foreign materials that remain on the surface of the charging roller 14 may be transferred to the axial end surface 14C (see FIG. 7) from the axial end portion of the charging roller 14, for example, by the rotation of the charging roller 14 and the driven rotation of the cleaning roller 102 and accordingly may adhere to the axial end surface 14C. Some of foreign materials, such as a developer, that float inside the apparatus body 10A of the image forming apparatus 10 may adhere to the axial end surface 14C of the charging roller 14. However, these foreign materials that adhere to the axial end surface 14C do not cause any problem because the conditions of the axial end surface 14C of the charging roller 14 do not affect image formation.

Figure 10:
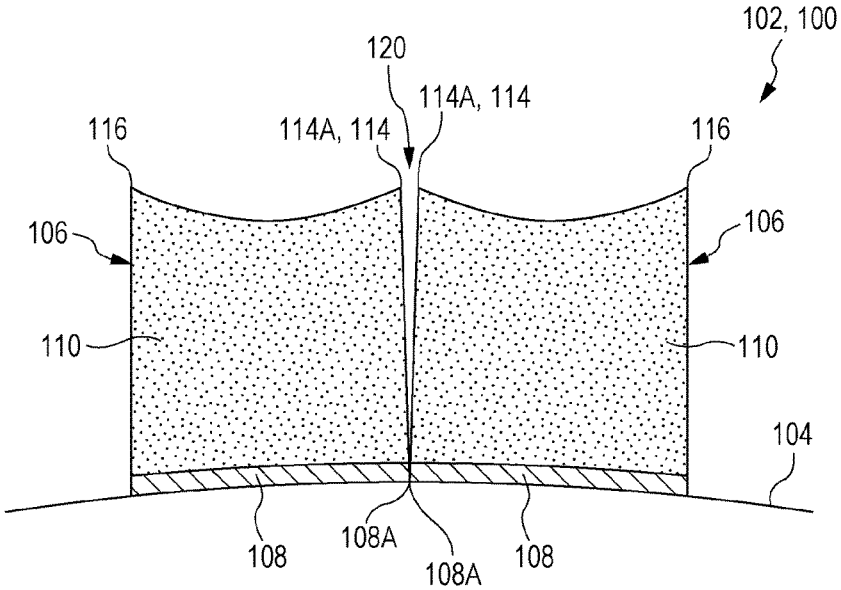
FIG. 10 is a schematic sectional view illustrating a first modification of a cleaning roller according to an exemplary embodiment as viewed in the axial direction.

The elastic layer 106 is not necessarily composed of one strip 110 and may be composed of two or more strips 110. That is, for example, as illustrated in FIG. 10, two strips 110 may be helically wound around the outer circumferential surface of the shaft 104 such that the lateral end surfaces 108A of adjacent adhesive layers 108 are in contact with each other.

That is, two strips 110 may be wound around the shaft 104 next to each other without any space, so that the division portion 120 having plural divided segments may be formed in the longitudinal (the axial direction of the shaft 104) central portion of the cleaning roller 102. As a result, the protrusions 114A may be formed in the lateral central portion 114 of the elastic layer 106 composed of these two strips 110.

Figure 11:
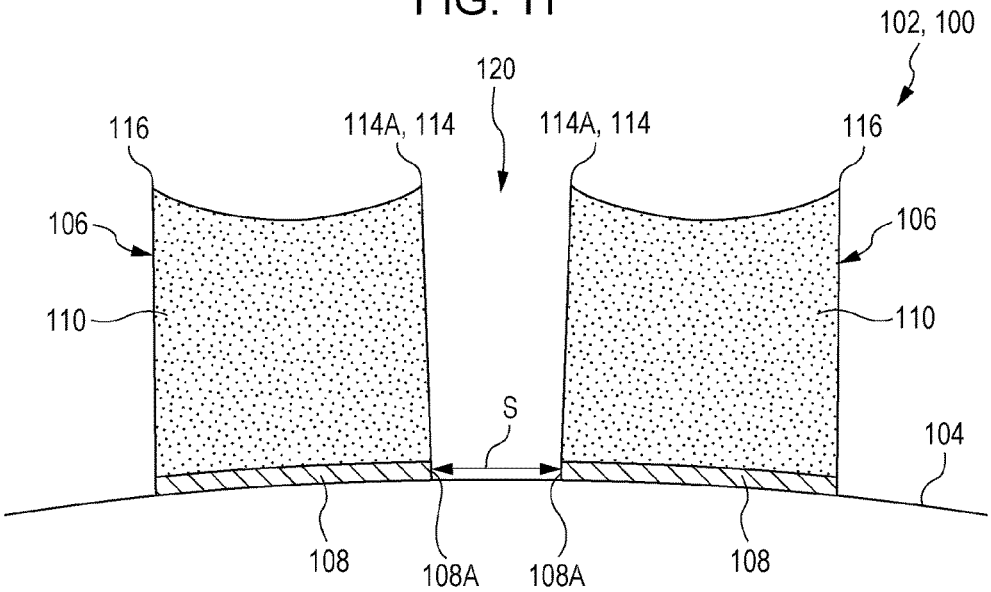
FIG. 11 is a schematic sectional view illustrating a second modification of a cleaning roller according to an exemplary embodiment as viewed in the axial direction.

For example, as illustrated in FIG. 11, two strips 110 may be helically wound around the outer circumferential surface of the shaft 104 such that the lateral end surfaces 108A of adjacent adhesive layers 108 are not in contact with each other (a space S is formed between the end surfaces 108A).

That is, two strips 110 may be wound around the shaft 104 next to each other with the space S, so that the division portion 120 having plural divided segments may be formed in the longitudinal (the axial direction of the shaft 104) central portion of the cleaning roller 102. As a result, the protrusions 114A may be formed in the lateral central portion 114 of the elastic layer 106 composed of these two strips 110.

EXAMPLES

Although exemplary embodiments will be described below in detail by way of Examples 1 to 7 and Comparative Examples 1 to 5, the exemplary embodiments are not limited to the following Examples. The charging roller 14 is the same in Examples 1 to 7 and Comparative Examples 1 to 5. Thus, a specific example of the charging roller 14 is described only in Example 1.

Example 1

Charging Roller

Formation of Elastic Layer

A mixture described below is kneaded with an open roller. The kneaded mixture is placed in a cylindrical shape so as to have a thickness of 1.5 mm around the outer circumferential surface of a conductive shaft 14A. The conductive shaft 14A is made of SUS416 and has a diameter of 9 mm. The obtained product is placed in a cylindrical mold having an inner diameter of 12.0 mm and vulcanized at 170° C. for 30 minutes. The vulcanized material is taken out of the mold and then polished. This process provides a cylindrical conductive elastic layer 14B.

- Rubber material (epichlorohydrin-ethylene oxide-allyl glycidyl ether copolymer rubber, Gechron 3106 available from Zeon Corporation) . . . 100 parts by weight
- Conductive agent (carbon black, Asahi Thermal available from Asahi Carbon Co., Ltd.) . . . 25 parts by weight
- Conductive agent (Ketjenblack EC available from LION Corporation) . . . 8 parts by weight
- Ion conductive agent (lithium perchlorate) . . . 1 part by weight
- Vulcanizing agent (sulfur, 200 mesh available from Tsurumi Chemical Industry Co., Ltd.) . . . 1 part by weight
- Vulcanization accelerator (NOCCELER DM available from Ouchi Shinko Chemical Industrial Co., Ltd.) . . . 2.0 parts by weight
- Vulcanization accelerator (NOCCELER TT available from Ouchi Shinko Chemical Industrial Co., Ltd.) . . . 0.5 parts by weight.

Formation of Surface Layer

A mixture described below is mixed with a bead mill to obtain a dispersion. The obtained dispersion is diluted with methanol. The diluted dispersion is applied to the surface (outer circumferential surface) of the conductive elastic layer 14B by dip coating and then dried by performing heating at 140° C. for 15 minutes. This process provides a charging roller 14 having a surface layer with a thickness of 4 μm.

- Polymer material (copolymer nylon, AMILAN CM8000 available from Toray Industries, Inc.) . . . 100 parts by weight
- Conductive agent (antimony-doped tin oxide, SN-100P available from Ishihara Sangyo Kaisha, Ltd.) . . . 30 parts by weight
- Solvent (methanol) . . . 500 parts by weight
- Solvent (butanol) . . . 240 parts by weight Cleaning Roller 1

A urethane foam sheet having a thickness of 2.4 mm (EP-70 available from Inoac Corporation) is cut into a strip having a width of 6 mm and a length of 360 mm. A double-sided tape having a thickness of 0.05 mm (No. 5605 available from Nitto Denko Corporation) is stuck to the entire surface of the cut strip to produce a strip having the double-sided tape.

The strip having the double-sided tape is placed on a stage with the urethane foam sheet facing upward. A vertical cut is made, with a single-edged knife, in a lateral central portion of the strip in the region of from 107 mm to 253 mm distant from the longitudinal tip portion of the strip (the cut 112 is formed so as not to reach the double-sided tape). This process provides a strip 110 having the double-sided tape in which the longitudinal central portion is divided into two segments (divided into two segments of 3 mm each).

The obtained strip 110 having the double-sided tape is placed on a horizontal stage while a release liner attached to the double-sided tape faces downward. The longitudinal tip portion of the strip is compressed from above by using heated stainless steel such that the thickness of a portion of the strip in the range of 1 mm in longitudinal length from the longitudinal tip portion is 15% of the thickness of the other portion.

The obtained strip 110 having the double-sided tape is placed on a horizontal stage while the release liner attached to the double-sided tape faces upward. The strip 110 having the double-sided tape is wound around a metal shaft 104 (material=SUM24EZ, external diameter=Ø 5.0 mm, full length=338 mm) with tension such that the helix angle θ is 15° and the full length of the strip is elongated by from 0% to 5%.

This process provides a cleaning roller 1 in which the longitudinal central portion of a helically wound elastic layer 106 is divided into two segments in the region of from 100 mm to 238 mm (the division portion 120 having two divided segments is positioned in the region of from 100 mm to 238 mm in the longitudinal central portion of the elastic layer 106).

Example 2

Cleaning Roller 2

A cleaning roller 2 is produced in the same manner as for the cleaning roller 1 except for the following: a cut 112 formed in the longitudinal central portion of a strip 110 having a double-sided tape is located in the region of from 144 mm to 216 mm; and the position in which the longitudinal central portion of an elastic layer 106 is divided (the position of a division portion 120) is located in the region of from 135 mm to 203 mm after the strip 110 is wound helically.

Example 3

Cleaning Roller 3

A cleaning roller 3 is produced in the same manner as for the cleaning roller 1 except for the following: a cut 112 formed in the longitudinal central portion of a strip 110 having a double-sided tape is located in the region of from 80 mm to 280 mm; and the position in which the longitudinal central portion of an elastic layer 106 is divided (the position of a division portion 120) is located in the region of from 75 mm to 263 mm after the strip 110 is wound helically.

Example 4

Cleaning Roller 4

A cleaning roller 4 is produced in the same manner as for the cleaning roller 1 except for the following: a cut 112 formed in the longitudinal central portion of a strip 110 having a double-sided tape is located in the region of from 53 mm to 307 mm; and the position in which the longitudinal central portion of an elastic layer 106 is divided (the position of a division portion 120) is located in the region of from 50 mm to 288 mm after the strip 110 is wound helically.

Example 5

Cleaning Roller 5

A cleaning roller 5 is produced in the same manner as for the cleaning roller 1 except that the thickness of a urethane foam sheet is 2.8 mm.

Example 6

Cleaning Roller 6

A cleaning roller 6 is produced in the same manner as for the cleaning roller 1 except that the thickness of a urethane foam sheet is 2.8 mm and the helix angle θ is 25°.

Example 7

Cleaning Roller 7

A cleaning roller 7 is produced in the same manner as for the cleaning roller 1 except that the longitudinal central portion of a strip 110 having a double-sided tape is divided into three segments (three segments of 2 mm each).

Comparative Example 1

Comparative Cleaning Roller 1

A comparative cleaning roller 1 is produced in the same manner as for the cleaning roller 1 except that the longitudinal central portion of a strip having a double-sided tape is not divided (one segment of 6 mm).

Comparative Example 2

Comparative Cleaning Roller 2

A comparative cleaning roller 2 is produced in the same manner as for the cleaning roller 1 except for the following: a cut 112 formed in the longitudinal central portion of a strip having a double-sided tape is located in the region of from 149 mm to 211 mm; and the position in which the longitudinal central portion of an elastic layer 106 is divided (the position of a division portion 120) is located in the region of from 140 mm to 198 mm after the strip is wound helically.

Comparative Example 3

Comparative Cleaning Roller 3

A comparative cleaning roller 3 is produced in the same manner as for the cleaning roller 1 except for the following: a cut 112 formed in the longitudinal central portion of a strip having a double-sided tape is located in the region of from 43 mm to 317 mm; and the position in which the longitudinal central portion of an elastic layer 106 is divided (the position of a division portion 120) is located in the region of from 40 mm to 298 mm after the strip is wound helically.

Comparative Example 4

Comparative Cleaning Roller 4

A comparative cleaning roller 4 is produced in the same manner as for the cleaning roller 1 except that the thickness of a urethane foam sheet is 2.0 mm.

Comparative Example 5

Comparative Cleaning Roller 5

A comparative cleaning roller 5 is produced in the same manner as for the cleaning roller 1 except that the thickness of a urethane foam sheet is 3.0 mm and the helix angle θ is 35°.

Evaluation

FIG. 12 shows the evaluation results regarding the evaluation of the position in which the longitudinal central portion is divided (the position of the division portion 120), the ratio of the length of the division portion 120 to the full length, the minimum thickness part, the amount of nipping between each cleaning roller and the charging roller 14, the in-plane density unevenness, and the cleaning performance for the cleaning rollers 1 to 7 produced in Examples and the comparative cleaning rollers 1 to 5 produced in Comparative Examples. The in-plane density unevenness and the cleaning performance are evaluated in the following manners.

Evaluation of In-Plane Density Unevenness

A test for evaluating the in-plane density unevenness is performed by installing the cleaning roller produced in each Example or each Comparative Example and the charging roller 14 into a drum cartridge in color multifunction device DocuCentre-V C7775 available from Fuji Xerox Co., Ltd.

In the evaluation test, a full halftone image with 50% density is outputted in an environment at 10° C. and 15 RH %, and the in-plane density unevenness caused by each cleaning roller for the charging roller 14 is evaluated. Specifically, the image density is determined in ten randomly selected image-printed areas with X-Rite 404. The in-plane density unevenness is evaluated from the difference between the maximum value and the minimum value of the image density based on the following criterion.

Evaluation of In-Plane Density Unevenness: Criterion

G0: The difference between the maximum value and the minimum value is 0.10 or less.

G1: The difference between the maximum value and the minimum value is more than 0.10 and 0.15 or less.

G2: The difference between the maximum value and the minimum value is more than 0.15.

Evaluation of Cleaning Performance

A test for evaluating the cleaning performance is performed by installing the cleaning roller produced in each Example or each Comparative Example and the charging roller 14 into a drum cartridge in color multifunction device DocuCentre-V C7775 available from Fuji Xerox Co., Ltd.

In the evaluation test, an image quality pattern having 100% image density and having a strip shape 200 mm in output-direction length×30 mm in width is printed on 50,000 sheets of A4 recording paper in an environment at 10° C. and 15 RH %. The performance in cleaning adhering materials is then evaluated by observing the surface conditions of the charging roller 14 in a position in which the image quality pattern is printed. The cleaning performance is evaluated based on the following criterion by directly observing the surface of the charging roller 14 with a confocal laser scanning microscope (OLS1100 available from Olympus Corporation).

Evaluation of Cleaning Performance: Criterion

G0: Adhering materials are found in the range of 10% or less per square micrometers of the surface of the charging roller.

G1: Adhering materials are found in the range of more than 10% and 30% or less per square micrometers of the surface of the charging roller.

G2: Adhering materials are found in the range of more than 30% and 50% or less per square micrometers of the surface of the charging roller.

The evaluation results shown in Table of FIG. 12 reveal that the cleaning rollers 1 to 7 produced in Examples are superior to the comparative cleaning rollers 1 to 5 produced in Comparative Examples in terms of in-plane density unevenness and cleaning performance.

Although the cleaning roller 102 (cleaning body) according to the exemplary embodiment is described above based on the figures and Examples, the cleaning roller 102 according to the exemplary embodiment is not limited to those illustrated in the figures and those described in Examples, and various changes, modifications, and improvements can be made without departing from the spirit of the present invention. For example, in the exemplary embodiment, the charging roller 14 is driven to rotate by the photoreceptor 12, but the charging roller 14 may rotate.

The cleaning roller 102 according to the exemplary embodiment is kept in contact with the charging roller 14. However, the cleaning roller 102 is not limited to this configuration and may be driven to rotate by contact with the charging roller 14 only in cleaning. Alternatively, the cleaning roller 102 may contact the charging roller 14 only in cleaning and may be rotated by separate driving at a circumferential speed different from that of the charging roller 14.

As described above, the image forming apparatus 10 according to the exemplary embodiment includes, as the charging device 50, a unit including the charging roller 14 and the cleaning roller 102 disposed in contact with the charging roller 14, that is, includes the charging roller 14 as a body to be cleaned. However, the body to be cleaned is not limited to the charging roller 14. For example, the body to be cleaned may be a photoreceptor (image carrier) or the like.

The unit including the body to be cleaned (charging roller 14) and the cleaning body (cleaning roller 102) disposed in contact with the body to be cleaned may be disposed directly in the image forming apparatus 10 or may be disposed as a cartridge like the process cartridge 18 in the image forming apparatus 10. The image forming apparatus 10 including the cleaning roller 102 according to the exemplary embodiment is not limited to that having the above-mentioned structure and may be, for example, an intermediate transfer-type image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning body comprising:

a shaft; and an elastic layer that is helically wound around the shaft from one end side to the other end side of the shaft and fixed on the shaft wherein the elastic layer is configured to clean a body while the elastic layer rotates, wherein the elastic layer comprises:

a division portion having a plurality of divided segments, extending 20% to 70% of a full length of the elastic layer and being located in a longitudinal central portion of the elastic layer; and at least one undivided portion, wherein, in a cross-sectional view in an axial direction of the shaft, a minimum thickness in the vertical direction of the plurality of divided segments is 5% to 12% thicker than a minimum thickness in the vertical direction of the at least one undivided portion, and wherein, in the cross-sectional view in the axial direction of the shaft, protrusions on lateral end portions of the plurality of divided segments protrude farther than protrusions on lateral central portions of the plurality of divided segments.

2. The cleaning body according to claim 1, wherein the division portion further extends 30% to 60% of the full length of the elastic layer, and is located in the longitudinal central portion of the elastic layer.

3. The cleaning body according to claim 1, wherein the division portion further extends 40% to 50% of the full length of the elastic layer, and is located in the longitudinal central portion of the elastic layer.

4. The cleaning body according to claim 1, wherein an amount of nipping between the longitudinal central portion of the elastic layer and the body to be cleaned is larger than an amount of nipping between each longitudinal end portion of the elastic layer and the body to be cleaned.

5. The cleaning body according to claim 1, wherein an amount of nipping between the longitudinal central portion of the elastic layer and the body to be cleaned is from 13% to 26% larger than an amount of nipping between each longitudinal end portion of the elastic layer and the body to be cleaned.

6. An assembly comprising:

a cleaning device that includes the cleaning body according to claim 1, the cleaning body cleaning a rotating body to be cleaned while being driven to rotate by contact with the body to be cleaned;

a body to be charged; and a charging body that charges the body to be charged and serves as the rotating body to be cleaned, wherein the assembly is removably attachable to an image forming apparatus body.

7. An image forming apparatus comprising:

a cleaning device that includes the cleaning body according to claim 1, the cleaning body cleaning a rotating body to be cleaned while being driven to rotate by contact with the body to be cleaned;

an image carrier that carries an image;

a charging body that charges the image carrier and serves as the rotating body to be cleaned;

an exposure device that exposes the image carrier charged by the charging body and forms an electrostatic latent image; and a developing device that develops the electrostatic latent image formed on the image carrier by the exposure device.

8. The cleaning body according to claim 1, wherein the protrusions on the lateral end portions and the protrusions of the lateral central portions are configured to remove foreign materials on a charging roller.

9. The cleaning body according to claim 1 further comprising an adhesive layer provided on the shaft, the elastic layer being provided on the adhesive layer, wherein the division portion having the plurality of divided segments comprises a linear cut, wherein a depth of the cut does not reach the adhesive layer.

10. A cleaning body comprising:

a shaft; and an elastic layer that is helically wound around the shaft from one end side to the other end side of the shaft and fixed on the shaft and wherein the elastic layer is configured to clean a body while the elastic layer rotates, wherein the elastic layer includes a division portion having a plurality of divided segments, extending 20% to 70% of a full length of the elastic layer and being located in a longitudinal central portion of the elastic layer; and at least one undivided portion, wherein, in a cross-sectional view in an axial direction of the shaft, a minimum thickness in the vertical direction of the plurality of divided segments is 5% to 12% thicker than a minimum thickness in the vertical direction of the at least one undivided portion, and wherein the plurality of divided segments are formed intermittently in a longitudinal direction of the elastic layer.

* * * * *